US006408920B1

(12) United States Patent
Tanizaki et al.

(10) Patent No.: US 6,408,920 B1
(45) Date of Patent: Jun. 25, 2002

(54) PRESS-BONDING JIG FOR PRESSING VERTICAL PLATE MATERIALS ON HORIZONTAL PLATE MATERIALS AND METHOD OF USING SAME TO BOND VERTICAL PLATE MATERIALS ON HORIZONTAL PLATE MATERIALS

(75) Inventors: Yakuzo Tanizaki, Tokyo; Seigi Suzuki; Shigeyuki Nishiura, both of Toyohashi, all of (JP)

(73) Assignee: Du Pont-MRC Co., Ltd., Tokyo (JP)

( * ) Notice: Subject to any disclaimer, the term of this patent is extended or adjusted under 35 U.S.C. 154(b) by 0 days.

(21) Appl. No.: 09/508,015

(22) PCT Filed: Jul. 28, 1998

(86) PCT No.: PCT/JP98/03353

§ 371 (c)(1),
(2), (4) Date: Mar. 6, 2000

(87) PCT Pub. No.: WO99/11435

PCT Pub. Date: Mar. 11, 1999

(30) Foreign Application Priority Data

Sep. 3, 1997 (JP) ..... 9-238638

(51) Int. Cl.[7] ..... B30B 15/00
(52) U.S. Cl. ..... 156/581; 156/580
(58) Field of Search ..... 156/228, 580, 156/581, 583.1; 100/315, 324, 237

(56) References Cited

U.S. PATENT DOCUMENTS 4,666,551 A * 5/1987 Soberay et al. ..... 156/382
4,875,966 A * 10/1989 Perko ..... 156/580

FOREIGN PATENT DOCUMENTS

| | | |
|---|---|---|
| JP | 50-126812 | 10/1975 |
| JP | 61-12680 | 1/1986 |
| JP | 62-191102 | 8/1987 |

* cited by examiner

*Primary Examiner*—James Sells
(74) *Attorney, Agent, or Firm*—Bell, Boyd & Lloyd LLC

(57) ABSTRACT

A method capable of bonding lengthy horizontal plate materials and lengthy vertical plate materials to each other without skill of a worker and with uniform and beautiful finish, and a press-bonding jig used for the method. The press-bonding jig is set at a workbench, which has a vertical wall section for positioning lengthy horizontal plate materials and lengthy vertical plate materials, or at a member disposed around the workbench to press and fix the respective plate materials to each other along edges thereof, comprising a frame having a sufficient length to support the plate materials and holding air cylinders for actuating rubber pads in a pressing direction, and means for starting and stopping the air cylinders. The press-bonding jig is used to made complicated manual fixing operation needless and enables bonding in a short time with a beautiful finish.

10 Claims, 4 Drawing Sheets

PRESS-BONDING JIG FOR PRESSING VERTICAL PLATE MATERIALS ON HORIZONTAL PLATE MATERIALS AND METHOD OF USING SAME TO BOND VERTICAL PLATE MATERIALS ON HORIZONTAL PLATE MATERIALS

TECHNICAL FIELD

The present invention relates to a press-bonding jig for press-bonding a vertical plate material to a horizontal plate material along an edge portion of the horizontal plate material, and to a method of bonding a vertical plate material to the horizontal plate material by using the jig. For example, it relates to a press-bonding jig used for bonding a front-edge plate material or a backsplash plate material consisting of a long plate material to a counter plate material consisting of a long horizontal plate material, and to a bonding method of bonding the front-edge plate material and the backsplash plate material to the counter plate material by using the press-bonding jig, in the case of manufacturing a system kitchen counter or a washbasin counter made of a solid surface.

BACKGROUND ART

In recent years, solid surface are increasingly used for various counters in the households, restaurants, hotels and the like. A front-edge and a backsplash of a kitchen counter or a washbasin counter made of a solid surface are formed by separately cutting out their respective materials from a sheet plate material and bonding them to a counter plate material. According to a conventional bonding method, as shown in FIGS. 4 to 7, adhesive is applied to a bonding surface, a front-edge plate material 2' and a backsplash plate material 3' are positioned relative to each other, and thereafter, fixtures 15 such as G-clamps or sash cramps are fastened and fixed at about 10 cm intervals manually throughout the entire length of a counter plate material 1', so that the front-edge plate material and the backsplash plate material can be press-bonded to the counter plate material 1' through the entire length thereof with an almost uniform force.

In the above-stated fixing method using G-clamps or sash cramps, however, plate materials tend to be shifted from one another when clamping them with G-clamps or sash cramps, therefore expertise is required to bond them at predetermined angles and predetermined positions. Further, due to such manual operation, even an expert cannot constantly finish it to be a precise assembly. Besides, many G-clamps or sash cramps are needed and it takes lot of time to attach and detach them.

DISCLOSURE OF THE INVENTION

It is, therefore, an object of the present invention to provide a press-bonding jig which does not require expertise to carry out press-bonding operation which has been conventionally conducted by manually fastening G-clamps or sash cramps, and which can press-bond a front-edge plate material and a backsplash plate material to a counter plate material in a short time, and to provide a bonding method capable of ensuring a beautiful finish in a constant shape by using the press-bonding jig.

To attain the above object, the present invention mainly comprises a press-bonding jig for press-bonding a vertical plate material to a horizontal plate material, set at a workbench having a positioning means for positioning a long horizontal plate material and a long vertical plate material or at a member disposed around the workbench to press and fix the respective plate materials to each other along edge portions thereof, characterized by comprising at least one pressing member for press-bonding the respective plate materials along a length direction thereof; a plurality of actuation means disposed along a pressing and bonding surface of the plate materials for actuating the pressing member in a pressing direction; and a start/stop means for starting and stopping the actuation means, wherein said horizontal plate material is a counter plate material and said vertical plate material is a front-edge plate material and a backsplash plate material, said actuation means of said pressing member for pressing said front-edge plate material are horizontally arranged at intervals of not less than four means/m, and said actuation means of said pressing member for pressing said backsplash plate material are horizontally arranged at intervals of not less than three means/m and vertically arranged at not less than four means/m.

A fluid pressure cylinder can be employed as the actuation means. Alternatively, a cylinder-type air spring or a magnet spring can be employed as the actuation means.

The pressing members are in plural and are attached to the plurality of the actuation means, respectively. Alternatively, a plurality of the pressing members may be provided, and attached and connected to some of the plurality of actuation means. Further, the pressing means may be single, and attached and connected to all of the actuation means.

Further, it is preferable that the press-bonding jig further comprises an actuation control means for first actuating the actuation means arranged at a center in the length direction among the plurality of actuation means and next actuating the actuation means arranged at both sides of the actuation means at the center sequentially toward the both ends of the means.

Moreover, another aspect of the present invention mainly comprises a bonding method for pressing and bonding a long vertical plate material and a long horizontal plate to each other at their edge portions in a length direction thereof, characterized by press-bonding the horizontal and vertical plate materials using any one of the above-stated press-bonding jigs.

When the plate materials are made of a solid surface and the vertical plate material is a backsplash plate material and/or a front-edge plate material for a counter, it is preferable that the front-edge plate material is pressed with a force not less than 6 $kg/cm^2$ in a horizontal direction, and the backsplash plate material is pressed with a force not less than 1 $Kg/cm^2$ in a horizontal direction and with a force not less than 7 $Kg/cm^2$ in a vertical direction, independently of each other.

When the above-stated front-edge plate material and the backsplash plate materials are to be bonded to and assembled with the counter plate material of a kitchen counter for instance, the above-stated pressure-bonding jig is set at and around the workbench, and the counter plate material is mounted on the workbench and then the front-edge and backsplash plate materials are mounted to the counter plate material in a state that adhesive is applied to the bonding surfaces of the respective plate materials. Thereafter, the actuation members of the press-bonding jig of the present invention are actuated and the front-edge plate material and the backsplash plate materials are pressed to the counter plate material by the pressing members. At this moment, the respective plate materials are pressed against the positioning means of the workbench and kept positioned at predetermined positions by the operation of the actuation members. Due to this, the plate materials are not shifted relative to one another. Further, there is no irregularity in the pressing force that was seen in the manual operation, and the plate materials are press-bonded with a uniform pressing force in a longitudinal direction thereof. Hence, the plate materials can be bonded beautifully into a constant shape. Furthermore, working time can be greatly shortened and working efficiency can be improved since it is not necessary to fix many fixtures to the plate materials.

Although the present invention can be made in many different forms, the presently preferred embodiments are described in this disclosure and shown in the attached drawings. This disclosure exemplifies the principles of the present invention and does not limit the broad aspects of the invention only to the illustrated embodiments.

BEST MODE FOR CARRYING OUR THE INVENTION

Now, the best mode for carrying out the present invention will be described in detail with reference to the drawings.

Figure 1:
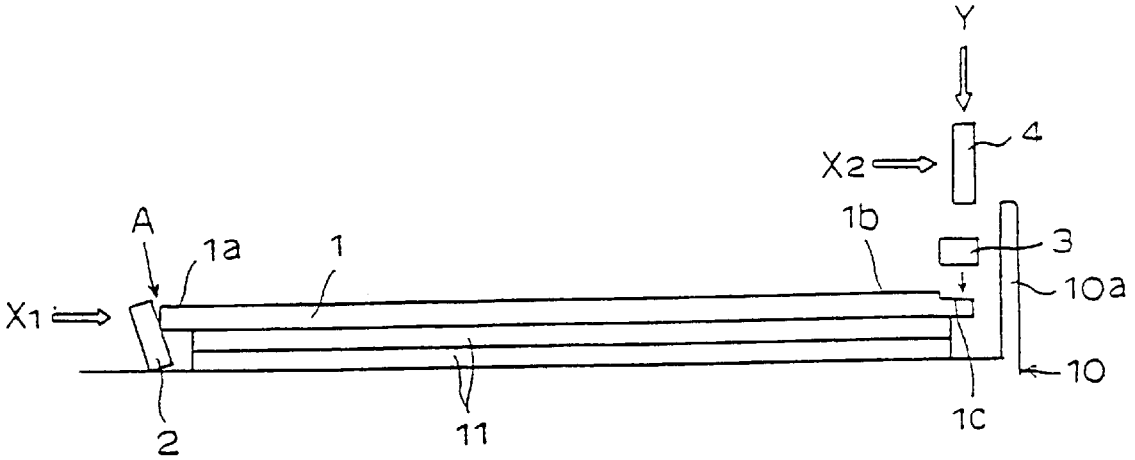
FIG. 1 is an explanatory view showing a bonding operation by a bonding method according to the present invention.
Figure 2:
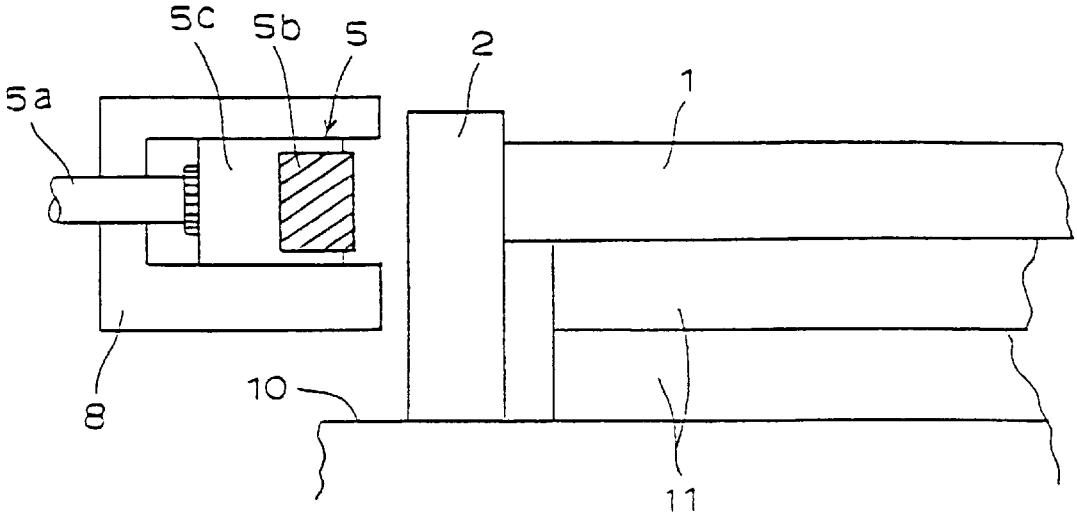
FIG. 2 is an explanatory view showing a bonding operation for bonding a front-edge plate material, including a press-bonding device according to the present invention.
Figure 3:
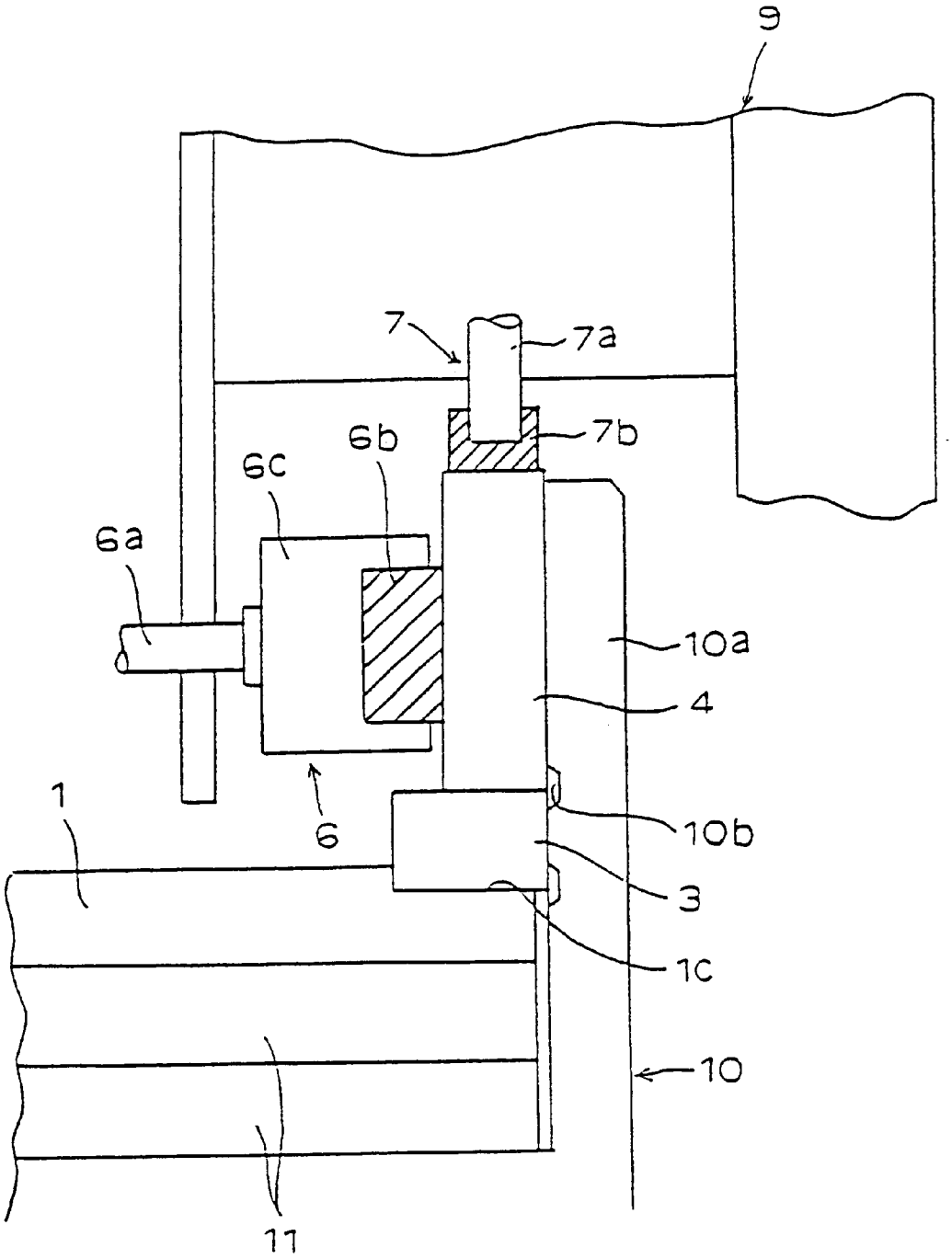
FIG. 3 is an explanatory view showing a bonding operation for bonding a backsplash plate material, including a press-bonding device according to the present invention.
Figure 4:
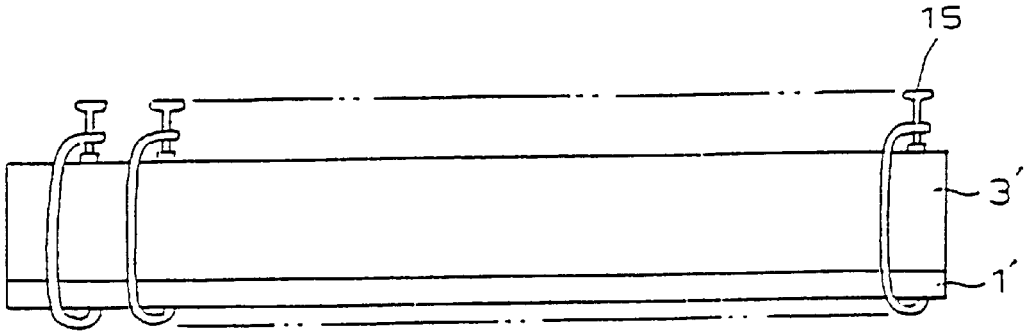
FIG. 4 is an explanatory view showing a conventional operation method of bonding a backsplash plate material to a counter plate material.
Figure 5:
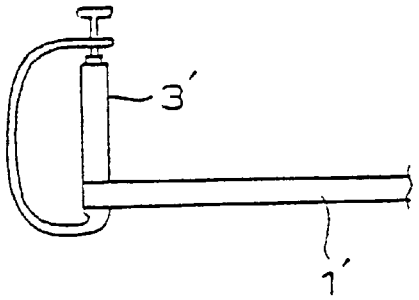
FIG. 5 is a side view of FIG. 4.
Figure 6:
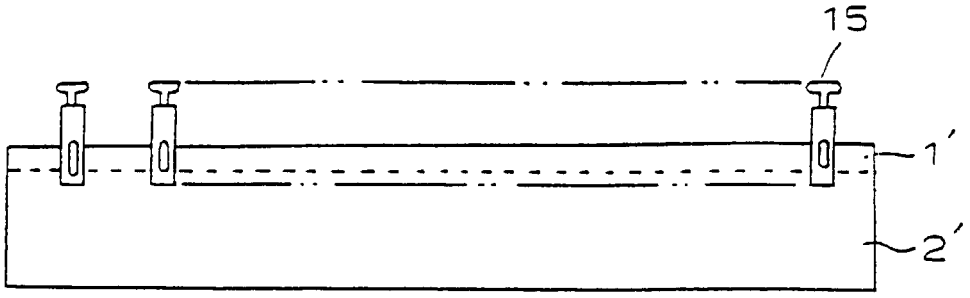
FIG. 6 is an explanatory view showing another conventional operation method of bonding a front-edge plate material to a counter plate material.
Figure 7:
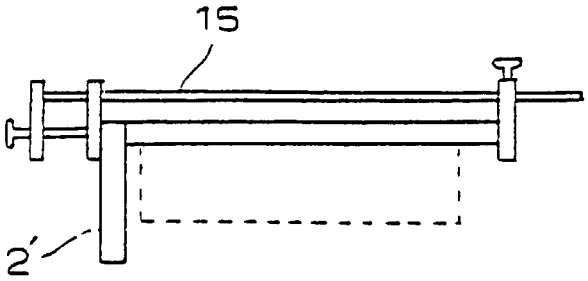
FIG. 7 is a side view of FIG. 6.

FIG. 1 is an explanatory view schematically showing bonding procedures by means of a bonding method according to the present invention, and FIG. 2 and FIG. 3 are partial explanatory views each including a part of a press-bonding jig according to the present invention.

In this embodiment, although an example of manufacturing a kitchen counter in a system kitchen using solid surfaces is described, the present invention is also applicable in assembling by using other materials, for example, wood, natural marble, ordinary synthetic resin plate material and the like.

Reference 1 denotes a counter plate material for a kitchen counter in a system kitchen, reference 2 denotes a front-edge plate material for the kitchen counter, and references 3 and 4 denote first and second backsplash plate materials for the kitchen counter. All of the plate materials are made of a solid surface (Registered Trademark: Du Pont Corian Cameo White). The front-edge plate material 2 and the first and second backsplash plate materials 3 and 4 are obtained by cutting a sheet of 2750 mm in length, 760 mm in width and 13 mm in thickness into parts of their respective predetermined dimensions. The first backsplash plate material 3 consists of a long rectangle and the second backsplash plate material 4 consists of a flat of the same length as that of the rectangle.

An end face of the front end 1*a* of the counter plate material 1 is contacted to the front-edge plate material 2 along its upper edge of a back surface of the front-edge plate material 2, thereby bonding the front-edge plate material 2 at right angle in a downward direction. On the other hand, a rear end 1*b* of the counter plate material 1 has a step portion 1*c* formed by shallowly notching an upper corner of the counter plate material 1 in a width 0 to 2 mm smaller than a fore-and-aft width of the first backsplash plate material 3. The first backsplash plate material 3 is perpendicularly bonded to the step portion 1*c* in a state where a lower end of the first backsplash plate material 3 is engaged with the step portion 1*c*. Further, the second backsplash plate material 4 is bonded onto an upper surface of the first backsplash plate material 3 from above in such a manner that the back surface of the second backsplash plate material 4 is flush with a rear end face of the first backsplash plate material 3. Thus, a kitchen counter of the system kitchen is assembled.

A press-bonding jig of the present invention to be used for this assembling is set at or around a workbench 10 having a positioning means for positioning the front-edge plate material 2 and the first and second backsplash plate materials 3 and 4 relative to the counter plate material 1. The press-bonding jig has a frame having almost the same length as those of the front-edge plate material 2 and the first and second backsplash plate materials 3 and 4. A plurality of pressing members, which are provided for press-bonding the front-edge plate material 2 and the first and second backsplash plate materials 3 and 4 in the length direction of the counter plate material 1, respectively, are held to the frame. Further, the jig of the invention comprises a plurality of actuation means for actuating the pressing members and a start/stop means for starting and stopping the actuation means. The jig further comprises an actuation control means for first actuating the actuation means arranged at a center of the plural actuation means in the length direction, then sequentially actuating the means arranged at the both sides thereof toward the both end sides of the actuation means.

In order to bond the front-edge plate material 2 and the first and second backsplash plate materials 3 and 4 to the counter plate material. 1, first, the press-bonding jig of the present invention is set at or around the workbench 10 and the counter plate material 1 is mounted on the workbench 10. At this moment, a plurality of supporting boards 11 are stacked on an upper surface of the workbench 10 so as to adjust a height of the supporting boards in such a manner the height is equal to a dimension equal to that obtained by subtracting the thickness of the counter plate material 1 from the vertical dimension of the front-edge plate material 2. The workbench 10 is provided with a vertical wall section 10*a* extending perpendicularly to the upper surface of the workbench 10 at an edge portion of the workbench 10, which serves as a positioning means of the present invention. The counter plate material 1 is mounted on the supporting boards 11 in a direction in which the rear end 1*b* of the counter plate material 1 faces the vertical wall section 10*a*. Thereafter, the front-edge plate material 2 is raised aslant in a direction in which the upper edge of the front-edge plate material is spaced from the front end 1*a* of the counter plate material 1 as shown in FIG. 1. At this moment, a V-shaped gap A is formed between the end face of the front edge 1*a* of the counter plate material 1 and the back surface of the front-edge plate material 2. Instantaneous adhesive, ARON ALPHA (made by TOAGOSEI Co., Ltd.), for solid surfaces is applied to a portion of the gap A throughout entire lengths of the counter plate material 1 and the front-edge plate material 2.

On the other hand, the adhesive is also applied to entire lengths of the lower end face of the first backsplash plate material 3 and to a lower end face of the second backsplash plate material 4. The first backsplash plate material 3 is then mounted on the step portion 1*a* of the counter plate material 1, and the second backsplash plate material 4 is mounted on the first backsplash plate material 3 along the upper edge of the rear end of the first backsplash plate material 3. In this state, a lever, which serves as a start means of the press-bonding jig, is manipulated to operate first to third air cylinders 5 to 7 serving as the actuation means of the present invention.

A plurality of first air cylinders 5 (eleven cylinders in this embodiment) are arranged along the length direction of the front-edge plate material 2 and press a front face of the front-edge plate material 2 rearward in an X1 direction in FIG. 1. Also, a plurality of second air cylinders 6 (six cylinders in this embodiment) are arranged along the length direction of the backsplash plate materials 3 and 4 and press a front face of the second backsplash plate material 3 rearward in an X2 direction. A plurality of third air cylinders 7 (eleven cylinders in this embodiments) are arranged along the length direction of the backsplash plate materials 3 and 4 and press an upper edge of the second backsplash plate material 3 downward in a Y direction.

Among the eleven first air cylinders 5, a first air cylinder 5 at a center thereof is independent of the other cylinders and the remaining ten first cylinders 5 are grouped into five pairs. Six pressing blocks 5*c* in total, which serve as pressing members of the present invention, are attached to tip ends of piston rods 5*a* of the first air cylinder 5 at the center and the five pairs of the first air cylinders 5, respectively. The six second air cylinders 6 are grouped into three pairs and three pressing blocks 6*c* are attached to the tip ends of piston rods 6*a* of the cylinders, respectively. The pressing blocks 5*c* and 6*c* are generally U-shaped in cross section. Rubber pads 5*b* and 6*b* are attached onto end faces of the pressing blocks 5*c* and 6*c* respectively, thereby preventing the plate materials 1 to 4 from being damaged when the blocks 5*c* and 6*c* are contacted with the plate materials 1 to 4. Also, eleven third air cylinders 7 in total are divided into a central portion group and adjacent portion groups. Three rubber pads 7*b* serving as pressing members are respectively attached onto end faces of piston rods 7*a* of a group of the plural third air cylinders 7 at the center and those of adjacent groups of the plural third air cylinders 7.

The plurality of first air cylinders 5 are fixedly attached to a frame 8 having a U-shaped cross section by inserting the piston rods 5*a* therethrough, respectively. As the piston rod 5*a* is expanded or contracted, the corresponding pressing block 5*c* and rubber pad 5*b* are slid inside the frame 8 and inserted into/projected from an opening portion of the frame 8. On the other hand, the second and third air cylinders 6 and 7, are fixedly attached to a frame 9 so that the cylinders 6 and 7, are actuated in a direction perpendicular to each other.

Although the pressing members are attached with a plurality of actuation means connected there to, respectively, in this embodiment, it is possible to attach a single pressing member to one actuation means or to attach and connect all of the plural actuation means to a single long pressing member.

In this embodiment, when the front-edge plate material 2 and the backsplash plate materials 3 and 4 are pressed against the counter plate material 1, the air cylinders 5 to 7 are used as the actuation means. It is also possible to use hydraulic cylinders, cylinder type air springs or magnet springs as the actuation means.

In this embodiment, air pressure of the first air cylinders 5 is set at 6 kg/cm$^2$, a air pressure of the second air cylinders 6 is set at 1 kg/cm$^2$ and air pressure of the third air cylinders 7 is set at 7 kg/cm$^2$. In this way, if the press-bonding jig of the present invention is used, it is possible to set the pressing force of the pressing members at arbitrary values and to uniformly press the long plate materials throughout the entire lengths thereof.

First, the first air cylinders 5 are operated by the start means and the front-edge plate material 2 is pressed rearward. Then, the counter plate material 1 is moved rearward and pressed against the vertical wall section 10*a*, thereby securely positioning of the plate material 1 so that the counter plate material 1 and the front-edge plate material 2 are strongly press-bonded between the vertical wall section 10*a* and the pressing members.

Furthermore, as stated above, the step portion 1*c* formed at the counter plate material 1, on which the first backsplash plate material 3 is engageably mounted, has a fore-and-aft width approximately 0 to 2 mm smaller than that of the first backsplash plate material 3. Due to this, the rear edge of the first backsplash plate material 3 is slightly protruded from the rear edge of the counter plate material 1. Therefore, as the counter plate material 1 is moved rearward, the first backsplash plate material 3 engageably mounted on the step portion 1*c* of the counter plate material 1 is contacted with and strongly pressed against the vertical wall section 10*a*, thereby press-bonding the backsplash plate material 3 to the step portion 1*c*.

Still further, the second backsplash plate material 4 is pressed against the vertical wall section 10*a* by the second air cylinders 6 actuated after the first air cylinders 5, and the first backsplash plate material 3 and the second backsplash plate material 4 are positioned securely so that the rear end face of the first backsplash plate material 3 is flush with the rear face of the second backsplash plate material 4. In that state, the second backsplash plate material 4 is pressed. downward by the third air cylinders 7 actuated almost simultaneously with the second air cylinders 6, thereby press-bonding the first and second backsplash plate materials 3 and 4 to the counter plate material 1.

In this embodiment, as shown in FIG. 3, a recessed groove portion 10*b* is respectively formed in the front surface of the vertical wall section 10*a* at a height position corresponding to a bonding surface between the first backsplash plate material 3 and the counter plate material 1 and that between the first backsplash plate material 3 and the second backsplash plate material 4, whereby any excessive adhesive flowing from the bonding surfaces can be contained in the recessed groove portions.

Among the plural first to third air cylinders 5 to 7 arranged along the longitudinal direction of the counter plate material 1, the groups of the air cylinders arranged at the centers in the longitudinal direction by the actuation control means, which are not shown in the drawings, are first actuated, then the groups of air cylinders arranged on both sides of the central groups are sequentially actuated toward the both ends and finally the air cylinder groups arranged at the both ends are actuated.

When the plate materials are bonded by the bonding method using the press-bonding jig of the present invention illustrated above, it takes two minutes to complete the operation from applying an adhesive to the counter plate material 1, front-edge plate material 2 and the backsplash plate materials 3 and 4 until press-bonding and bonding the plate materials. On the contrary, when the plate materials are bonded manually in a conventional hand clamp method, it takes seven and a half minutes to complete the bonding operation. Obviously, therefore, by employing the press-bonding jig and the bonding method of the present invention, working time is greatly shortened and working efficiency is improved.

As stated so far, by using the press-bonding jig of the present invention, working time can be greatly reduced to one-fourth of that required for the conventional case and working efficiency can be improved, as well. As for the finished state, the plate materials are surely positioned relative to one another, so that no displacement occurs. Further, there is no irregularity in the pressing force as seen in the manual operation and the plate materials are press-bonded with a constant pressing force in longitudinal direction. Hence, the plate materials can be bonded beautifully into a constant shape.

While the presently preferred embodiments have been illustrated and describe numerous changes and modification can be made without significantly departing from the spirit and scope of this invention. Therefore, the inventors intend that such changes and modifications are covered by the appended claims.

What is claimed is:

1. A press-bonding jig for press-bonding a vertical plate material to a horizontal plate material, set at a workbench having a positioning means for positioning a long horizontal plate material and a long vertical plate material or at a member disposed around the workbench to press and fix the respective plate materials to each other along edge portions thereof, characterized by comprising:

at least one pressing member for press-bonding the respective plate materials along a length direction thereof; a plurality of actuation means disposed along a pressing and bonding surface of the plate materials for actuating the pressing member in a pressing direction; and a start/stop means for starting and stopping the actuation means, wherein said horizontal plate material is a counter plate material and said vertical plate material is a front-edge plate material and a backsplash plate material, said actuation means of said pressing member for pressing said front-edge plate material are horizontally arranged at intervals of not less than four means/m, and said actuation means of said pressing member for pressing said backsplash plate material are horizontally arranged at intervals of not less than three means/m and vertically arranged at not less than four means/m.

2. A press-bonding jig according to claim 1, wherein said actuation means is a fluid pressure cylinder.

3. A press-bonding jig according to claim 1, wherein said actuation means is a cylinder-type air spring or a magnet spring.

4. A press-bonding jig according to claim 1, wherein said pressing members are in plural and are attached to the plurality of said actuating means, respectively.

5. A press-bonding jig according to claim 1, wherein a plurality of said pressing means are provided, and are attached and connected to some of the plurality of said actuation means.

6. A press-bonding jig according to claim 1, wherein said pressing means is single, and is attached and connected to all of the plurality of said actuation means.

7. A press-bonding jig according to any of claims 4 to 6, further comprising an actuation control means for first actuating said actuation means arranged at a center in the length direction among the plurality of said actuation means and next actuating said actuation means arranged at both sides of the actuation means at the center sequentially toward the both ends of the means.

8. A bonding method for pressing and bonding a long vertical plate material and a long horizontal plate to each other at their edge portions in a length direction thereof, characterized by press-bonding using one of the press-bonding jigs according to claim 1.

9. A bonding method according to claim 8 wherein said plate materials are made of solid surface.

10. A bonding method according to claim 9, wherein said front-edge plate material is pressed with a force not less than 6 $kg/cm^2$ in a horizontal direction, and said backsplash plate material is pressed with a force not less than 1 $Kg/cm^2$ in a horizontal and with a force not less than 7 $Kg/cm^2$ in a vertical direction, independently of each other.

* * * * *